United States Patent [19]

Ibrahim

[11] 4,326,385

[45] Apr. 27, 1982

[54] REFRIGERATED MERCHANDISER CABINET WITH AIR DEFROST PORTS

[75] Inventor: Fayez F. Ibrahim, Niles, Mich.

[73] Assignee: Tyler Refrigeration Corporation, Niles, Mich.

[21] Appl. No.: 202,626

[22] Filed: Oct. 31, 1980

Related U.S. Application Data

[63] Continuation-in-part of Ser. No. 8,927, Feb. 2, 1979, and a continuation-in-part of Ser. No. 25,473, Mar. 30, 1979, Pat. No. 4,245,482, and a continuation-in-part of Ser. No. 58,916, Jul. 19, 1979, Pat. No. 4,242,882, and a continuation-in-part of Ser. No. 101,069, Dec. 7, 1979, Pat. No. 4,265,090, and a continuation-in-part of Ser. No. 184,033, Sep. 4, 1980, and a continuation-in-part of Ser. No. 180,573, Aug. 25, 1980.

[51] Int. Cl.[3] ..... F25D 21/12; A47F 3/04

[52] U.S. Cl. ..... 62/82; 62/256; 62/282

[58] Field of Search ..... 62/82, 282, 255, 256; 312/116

[56] References Cited

U.S. PATENT DOCUMENTS

| | | | |
|---|---|---|---|
| 3,115,017 | 12/1963 | Kocher et al. | 62/282 X |
| 3,403,525 | 10/1968 | Beckwith et al. | 62/255 |
| 3,850,003 | 11/1974 | Beckwith et al. | 62/282 X |
| 3,937,033 | 2/1976 | Beckwith et al. | 62/282 X |
| 4,026,121 | 5/1977 | Aokage et al. | 62/256 X |
| 4,072,488 | 2/1978 | Johnston | 62/282 |
| 4,120,174 | 10/1978 | Johnston | 62/256 |
| 4,144,720 | 3/1979 | Subera et al. | 62/282 X |
| 4,145,893 | 3/1979 | Vogel | 62/256 X |
| 4,207,747 | 6/1980 | Subera et al. | 62/82 |
| 4,283,922 | 8/1981 | Subera et al. | 62/256 |

*Primary Examiner*—Lloyd L. King

*Attorney, Agent, or Firm*—LeBlanc, Nolan, Shur & Nies

[57] ABSTRACT

A refrigerated display cabinet having air outlet ports in the top wall thereof for expelling ambient defrost air to the outside of the cabinet so that the air will not reenter the product display space. A baffle plate provided for blocking the passage of ambient defrost air into the top portion of the refrigerated air conduit during the defrost cycle from which it could flow into the product display space. A protective ambient air band is established across the access opening during the defrost cycle during which the flow of ambient defrost air is prevented from entering the internal cabinet product display space. The gate covering the air outlet port is used to mechanically control the closure of the baffle plate blocking the flow of ambient defrost air into the internal product display space. The operation of the display cabinet permits ambient air flow in the primary air conduit in the same direction during both the refrigeration and defrost cycles of operation so that only unidirectional fan motors are required in the cabinet.

41 Claims, 7 Drawing Figures

REFRIGERATED MERCHANDISER CABINET WITH AIR DEFROST PORTS

RELATED APPLICATIONS

The present application is a continuation-in-part of my co-pending patent applications: Ser. No. 8,927 filed Feb. 2, 1979 and entitled REFRIGERATION SYSTEM USING AIR DEFROST; Ser. No. 25,473 filed Mar. 30, 1979 and entitled GLASS DOOR MERCHANDISER now U.S. Pat. No. 4,245,482; Ser. No. 58,916 filed July 19, 1979 and entitled GLASS DOOR MERCHANDISER now U.S. Pat. No. 4,242,882; Ser. No. 101,069 filed Dec. 7, 1979 and entitled GLASS DOOR MERCHANDISER WITH AMBIENT AIR DEFROST, now U.S. Pat. No. 4,265,090; Ser. No. 184,033 filed Sept. 4, 1980 and entitled ENERGY EFFICIENT REFRIGERATED MERCHANDISER; and Ser. No. 180,573 filed Aug. 25, 1980 entitled REFRIGERATED DISPLAY CASE WITH AMBIENT AIR DEFROST INLET PORT. All of these identified applications are hereby incorporated by reference as though fully set forth herein.

BACKGROUND OF THE INVENTION

The present invention relates to refrigerated display cabinets or cases having at least one air conduit and an ambient air defrost system. Of primary concern are display cases having access openings in their front walls. Both within the specification and the claims of the present application, all references to refrigeration apparatus or refrigeration operations are intended to include cooling both at a temperature below 32° F., such as associated with frozen food display cases, and in excess of 32° F., such as typically associated with dairy food and fresh meat display cases.

Refrigerated display cases having only a single air conduit with both front or top access openings have been used for many years. Such open front cases are conventionally utilized for displaying dairy and meat products.

In the operation of all types of refrigerated display cases, it is desirable to include a system capable of automatically defrosting the display case. The defrost cycle can be actuated either at set periodic times or when the frost buildup within the system has reached a certain predetermined level. Such systems are typically thermostatically controlled so as to switch from a refrigeration cycle to a defrost cycle of operation. By this manner of operation, it is possible to avoid any significant frost buildup within the display case.

Typically within the prior art, there have been three different approaches employed for defrosting refrigerated display cases. The first approach involves the use of electric resistance heaters which are arranged adjacent to the refrigerated coils of the refrigeration mechanism. During a defrost cycle, these heaters supply heat in an effort to melt the frost buildup on the coils but also add warmer air to the air conduit for circulation within the case. The particular technique is relatively simple both in its construction and operation. However, since the electrical heaters are high voltage heaters that utilize significant electricity during operation, the rapidly increasing cost of electricity makes it extremely uneconomical to employ such systems. Furthermore, the warm air circulated in the case can raise the temperature of the case too high. Thus, attempts have been made to find other alternatives to such a system.

A second type of system circulates hot compressed gaseous refrigerant through the refrigeration coils during the defrost cycle. During the defrost cycle, a valve control mechanism shuts off the supply of refrigerant to the refrigeration coils and alternatively feeds superheated compressed gaseous refrigerant through the coils. This hot gas serves to melt any frost that has formed on the refrigeration coils but simultaneously provides heat within the air conduit which can be circulated through the display case, which again is disadvantageous. While this type of system does not suffer from the high cost of operation of the electrical heater defrost system, the heated gas system involves a relatively high construction cost. Due to the requirement that the system be able to selectively switch between the supplying of heated gas and the supplying of refrigerant to the refrigeration coils, a complicated valving structure must be provided. Such a mechanism significantly increases the cost of construction of the display case. In addition, the provision of such a complicated system only increases the number of complex parts capable of breaking down and requiring costly repairs.

The third type of system employed for defrosting display cabinets relies upon the circulation of ambient air. It is this general category with which the invention of the present application is concerned. In such air defrost systems ambient air is often propelled through the same air conduits which are used to contain the refrigerated air during a refrigeration cycle of operation. Such air circulation encounters the problem that warm ambient air can be dumped into the product display space and the stored products can begin to thaw. In order to avoid such thermal shock, it is desirable to arrange for the circulation of ambient air into contact with the refrigeration coils while avoiding the dumping of warm ambient air into the product display space.

In open front refrigerated display cabinets having a plurality of air conduits for the circulation of multiple air bands, the circulation of the defrost air in the top most portion of the inner air conduit should be avoided since air flowing through the outlet port of the inner air conduit flows directly into the product display space. It is considered necessary, however, to circulate the ambient air through a portion of the inner air conduit so that this air which has a high specific heat can be used to defrost the refrigeration coils.

Another desirable feature in display cabinets having air defrost systems is to utilize air moving means which circulate both the refrigeration air band and the ambient air band during the defrost cycle of operation in the same direction whereby unidirectional fan motors can be employed. Another desirable construction feature is to design the refrigerated display cabinet with air conduits which extend the full length of the cabinet so that internal fixed baffles and partitioning wall structures can be avoided since such construction details materially raise manufacturing costs.

It is therefore, desirable to avoid the above problems while providing for an air defrost system in refrigerated display cabinets by providing a cabinet structure which permits the circulation of ambient air during the defrost cycle in the same direction as the refrigerated air band in the inner air conduit in a manner which eliminates the circulation of ambient air in the upper portion of this inner air conduit. At the same time, the present construction permits the circulation of both the refrigeration air bands and the ambient defrost air bands with the same motor-driven fan systems.

One type of system which employs ambient air during the defrost cycle is exemplified by those embodiments illustrated in U.S. Pat. Nos. 3,403,525, 3,850,003 and 3,937,033, all to Beckwith et al. Each of these systems uses fans separate from the main air circulating fans and cooperating structures which increases original construction cost. These extra fans are turned on during the defrost cycle for pulling ambient air from outside of the display case into the air conduits. A second type of system is illustrated in U.S. Pat. No. 3,082,612 to Beckwith, which system draws ambient air into the main circulation path through ports located in the lower front panel of the refrigerated display case. Such ports are normally closed during the refrigeration cycle and are opened during the defrost cycle. The Beckwith et al U.S. Pat. Nos. 3,850,003 and 3,937,033 both indicate that the concepts described in U.S. Pat. Nos. 3,082,612 and 3,403,525 did not prove to be practical and hence were not commercially feasible.

The Beckwith et al U.S. Pat. Nos. 3,850,003 and 3,937,033 show air defrost systems in which the air curtain across the access opening of the cabinet is interrupted during the defrost cycle which then causes refrigerated air contained within the display space to flow into the upper portion of the inner air conduits. This evacuation of the refrigerated air causes an inflow into the display space of ambient air due to the partial vacuum created. The net effect is to cause thermal shock to the stored products in a manner which should be avoided.

U.S. Pat. No. 3,403,525 to Beckwith et al also shows a cabinet which has a defrost and air defrost system which permits the flow of ambient air in the upper portion of the inner air conduit whereby thermal shock to the stored products can occur. Another feature of this refrigerated display cabinet is that the various air conduits are not continuous along the longitudinal length of the case whereby construction costs are considerably increased.

A third type of ambient air defrosting system is shown in U.S. Pat. No. 4,144,720 to Subera et al, which is assigned to the same assignee as the present application. In this patent, an open front refrigerated display case having primary and secondary air conduits is disclosed. In this sytem, reversible fans can be employed for reversing the direction of flow of air within the conduits and simultaneously drawing in air from outside of the display case.

Another system employing reversible fans for ambient air defrost is shown in U.S. Pat. No. 4,026,121 to Aokage. This patent, however, refers to short-circuiting the air flow between the primary and secondary air bands for the purpose of supplying warmer air to the primary band.

Other U.S. Pat. Nos. which show the use of various slats and gates to control air flow are: 2,124,268 to Williams; 2,525,868 and 2,525,869 both to Corhanidis; 3,094,851 and 3,122,892 both to Beckwith et al; 3,115,017 to Kocher et al; 3,226,945 to Spencer; 4,072,488 to Johnston; 4,148,197 to Karashima; 4,122,687 to McKee; and 3,319,557 to Perez.

U.S. Pat. No. 3,444,698 to Lorenz shows a refrigeration unit in which the fan speed is varied in the refrigeration cycle in order to more closely maintain a constant rate of heat transfer from the air to the heat exchanger.

One embodiment of an open front single air conduit display case using an ambient air defrost system is shown in published British patent application GB No. 2,016,669. This British application indicates that it corresponds to U.S. patent application Ser. No. 884,697 filed Mar. 8, 1978.

It has been recognized that an ambient air defrost operation can be incorporated into an open top refrigerated display case as disclosed in U.S. Pat. No. 4,120,174 to Johnston. The Johnston patent illustrates an open top case having a single air conduit extending around the case. During the refrigeration cycle, the air flows in a first direction and during the defrost cycle the direction of the air flow is reversed with ambient air being drawn into the conduit. The quantity of air flow during the defrost cycle is greater than during refrigeration. The defrost air, after passing through the conduit, is expelled in a direction up and over the refrigerated case.

Similar to the open top display case of the above-identified patent to Johnston, there also are open front single air conduit cases which employ the same air defrost techniques as disclosed by the Johnston patent. During the defrost operation of such air defrost cases, the volume of the reverse air flow is relatively high and significantly greater than the air flow during the refrigeration cycle. Such a greater flow is utilized so as to minimize the time needed for the defrost operation. The higher air volume flow in such cases causes the warmer defrost air to reenter the display case which potentially can damage the products in the case. In addition, the greater air flow causing the cold air to flow upwardly can result in hitting the customer in the face with such cold air.

In the above-described refrigerated display cases, the protective air curtain across the access opening is typically eliminated during the defrost cycle of operation. The elimination of the air curtain is particularly common in the prior art cases with ambient air defrost systems. Under some conditions, however, it may be undersirable for this protective air curtain to be eliminated even during the defrost cycle.

SUMMARY OF THE INVENTION

The refrigerated display cabinet of the present invention is provided with air outlet ports located in the top wall thereof for the expelling of ambient defrost air to the outside of the cabinet from a position at which the air will not reenter the product display space. A baffle plate is also provided for blocking the passage of the ambient defrost air into the top portion of the innermost air conduit from which it could flow over into the product display space. The construction of the display cabinet in the preferred embodiment allows the maintenance of a protective ambient air band across the access opening of the cabinet and simultaneously prohibits the flow of ambient defrost air into the product display space. The gate covering the air outlet port can, preferably, be used to mechanically control the closure of the baffle plate to block the flow of ambient defrost air from entering the product display space. The operation of the display cabinet in the defrost cycle permits ambient air flow in the primary air conduit in the same direction as during the refrigeration cycle of operation whereby only unidirectional fan motors are required.

It is therefore an object of the present invention to provide a refrigerated merchandiser cabinet with an improved air defrost system wherein the ambient defrost air is expelled through an air outlet port after being drawn into the cabinet through the access opening thereof.

Another object of the present invention is to provide an open front refrigerated merchandiser display cabinet which achieves a high energy efficiency during the defrost cycle by circulating ambient air in an improved manner.

Yet another object of the present invention is to provide an open front refrigerated merchandiser display cabinet in which the ambient defrost air circulated through the primary air band during the defrost cycle of operation is prevented from entering the product display space whereby thermal shock could adversely effect the stored products.

Yet another object of the present invention is to provide an improved air defrost system for refrigerated merchandiser display cabinets having either a single air conduit, a partial secondary air conduit or a full secondary air conduit and including, in the preferred emboidment, an ambient air band generating subsystem.

These objects are achieved by constructing the refrigerated merchandiser display cabinet of the present invention with a defrost air outlet port in the rear portion of the top wall so that the ambient defrost air is expelled from the cabinet in a manner so that it falls to the rear of the cabinet and does not reenter the front access opening. This construction permits the ambient air flow in the primary air conduit in the same direction in both the refrigeration and defrost cycles which thereby lowers construction costs by enabling unidirectional motors to be used. An internal conduit baffle plate is also provided for selectively blocking the air flow in the primary air conduit so that ambient defrost air does not spill into the product display space during the defrost cycle. This construction thus avoids the reverse air flow which has been used in some cabinets in the prior art disclosures whereby air is drawn in at the top portions of the cabinet and expelled from the air inlet near the bottom of the access opening. When such reverse defrost air flow is used, the defrost air usually enters the product display space.

DESCRIPTION OF THE PREFERRED EMBODIMENTS

Figure 1:
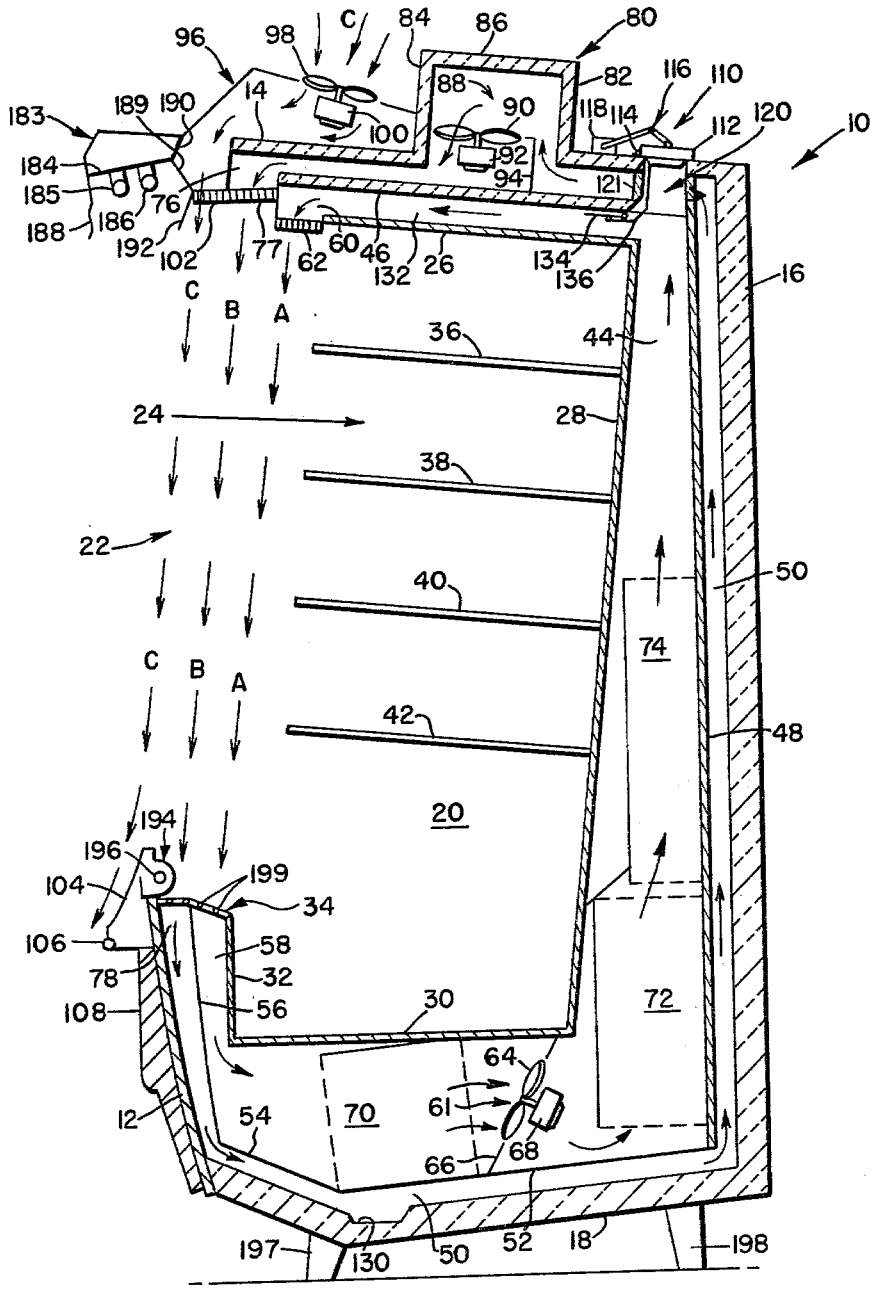
FIG. 1 is a cross-sectional schematic diagram of the refrigerated display cabinet of the present invention in a refrigeration cycle of operation with two circulated air bands and an ambient air band.
Figure 2:
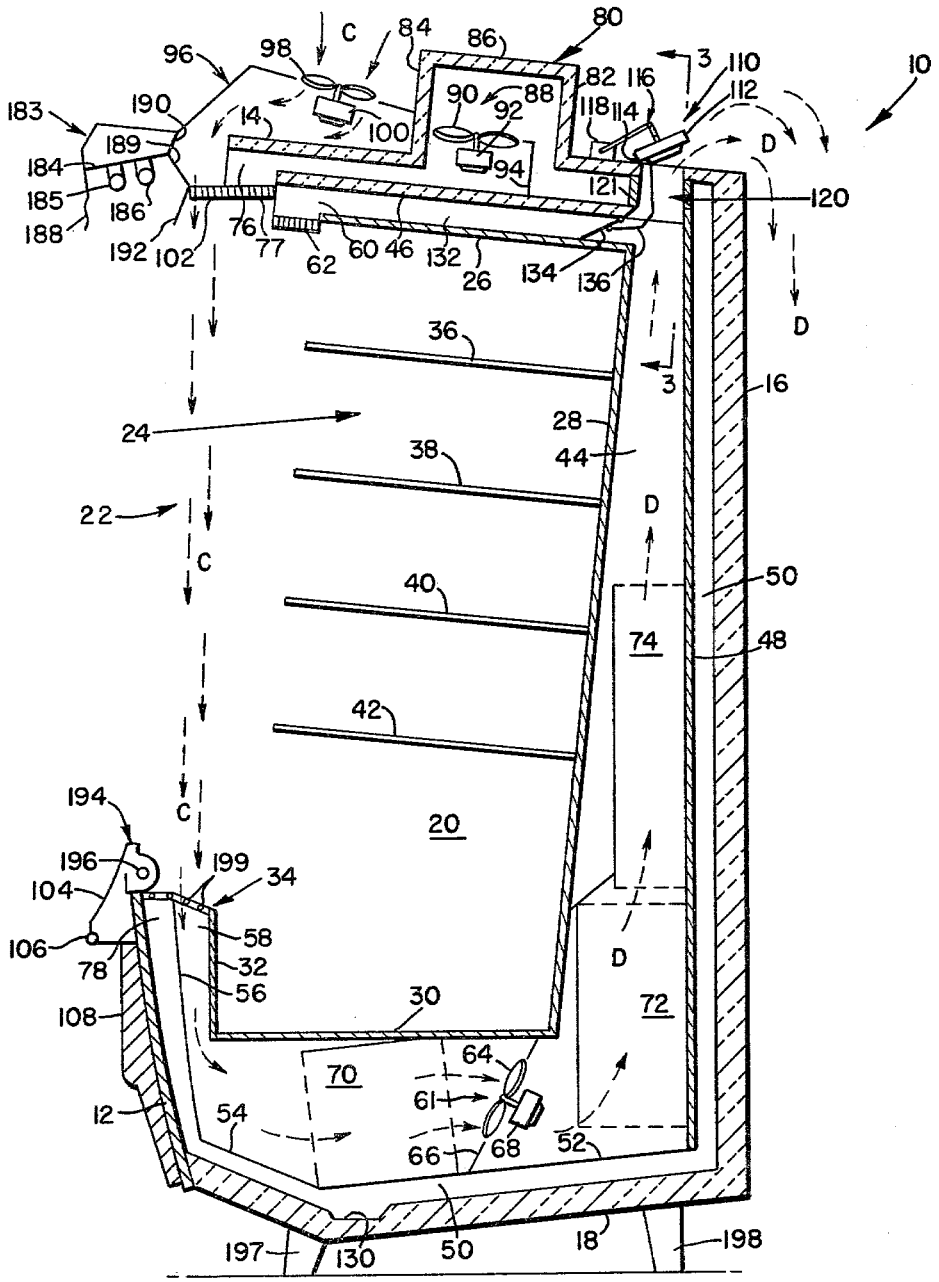
FIG. 2 shows the cabinet illustrated in FIG. 1 in a defrost cycle of operation.
Figure 3:
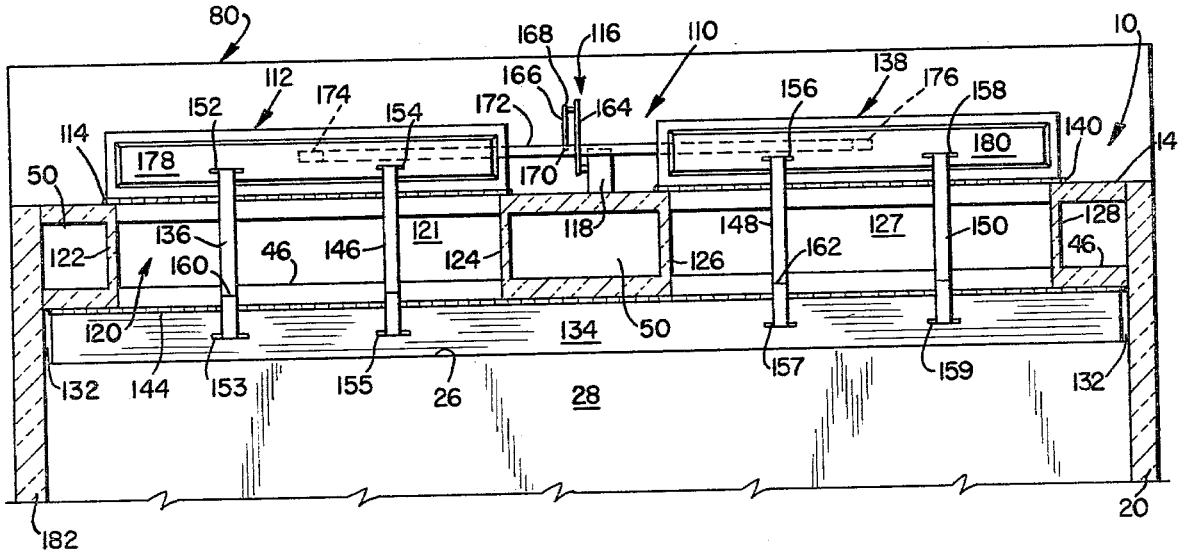
FIG. 3 shows a schematic diagram of a portion of the top structure of the cabinet illustrated in FIG. 2 taken on line 3—3 and illustrates the defrost ambient air outlet ports and the cover gates therefor.

Referring to FIGS. 1–3, a refrigerated merchandiser display cabinet 10 is shown with a lower front structural wall 12 and a top wall 14 which is connected at its rear edge to a rear wall 16. A bottom wall 18 is connected to the lower rear edge of rear wall 16 and to the structural front wall 12 by the front edge thereof. The walls 12–18 are connected at the opposite ends thereof to end wall 20. An access opening 22 is provided between the upper portion of front wall 12 and the front edge of top wall 14. A product display space 24 is formed by inner top wall 26 which is connected to an inner rear wall 28 which is in turn connected by the lower edge thereof to bottom inner wall 30. An inner front wall 32 connects the front edge of bottom inner wall 30 with air grille 34 which is in turn connected to the front structural wall 12. A series of product display shelves 36, 38, 40 and 42 are provided for product storage.

A first air conduit 44 is formed between the inner walls 26, 28, 30 and 32 and a series of divider panels. Top divider panel 46 is spaced below and is arranged parallel to top wall 14 and is positioned in a similar configuration above top inner wall 26. Divider panel 46 is connected, over a portion of its length at its rear edge with vertical divider panel 48 which is spaced from rear wall 16 in order to form a second air conduit 50 therebetween. The bottom edge of vertical divider panel 48 is connected to a bottom divider panel 52 which is spaced from and follows the contour of bottom wall 18 whereby an inclined front portion 54 is formed therein. The front edge of inclined panel 54 is connected to a front divider panel 56 which is in turn connected to the underside of air grille 34. Inlet opening 58 is formed between inner front wall 32 and front divider panel 56 immediately below air grille 34. This inlet 58 is a portion of the first air conduit 44 which extends between bottom inner wall 30 and bottom divider panel 52 and upwardly between inner rear wall 28 and divider panel 48 at the rear of the cabinet 10. This first air conduit then continues between top inner wall 26 and top divider panel 46 and terminates in an air outlet 60 immediately above downwardly directed louvers 62.

A first air moving means 61 is constituted by a motor-driven fan 64 positioned in a conduit baffle 66 in the bottom portion of the first air conduit. Motor-driven fan 64 is powered by a multi-speed, unidirectional motor 68. The fan 64 circulates air in the first air conduit 44 in a counterclockwise direction as shown by the flow arrows in both of the refrigeration cycle and the defrost cycle of operation. During the refrigeration cycle of operation, air entering the inlet 58 is propelled through refrigeration coil boxes 70, 72 and 74, although, if desired, only a single such refrigeration box need be used for dairy and meat cases. The multiple refrigeration boxes illustrated would provide sufficient cooling capacity to allow display case 10 to be operated as a low temperature cabinet, i.e, −25° F. to −35° F. The cabinet 10 is also usable as a medium temperature display case in which the temperature ranges from about 10° F. to 20° F.

The air circulated in the first air conduit 44 during the refrigeration cycle is propelled through air outlet 60 and thence through the downwardly directed louvers 62 in order to form air band A which then enters air inlet 58 through air grille 34 and circulates through the first air conduit 44. Also during the refrigeration cycle air band B is formed by propulsion of air through an air outlet 76 and downwardly directed louvers 77 immediately below top wall 14 at the front of cabinet 10. This secondary air band enters a secondary air inlet 78 which is formed immediately below air grille 34 between front divider panel 56 and front structural wall 12. The secondary air band B then continues circulation through a second air conduit 50 in a counterclockwise fashion. The second air conduit 50 is formed between the divider panels 56, 54, 52, 48, and 46 and the outer walls. Air band B is drawn into the secondary air moving means housing 80 which is integrally formed within top wall 14 by rear housing wall 82 and front housing wall 84 and a top housing wall 86. The secondary air moving means 88 consists of a motor-driven 90 having a unidirectional motor 92 mounted in a housing bracket 94 within housing 80. Operation of motor-driven fan 90 circulates the secondary air band B in a counterclockwise direction as shown in FIGS. 1 and 2. Heat transfer from the secondary air band B through the above-described divider panels, as well as direct convection heat transfer over the passage of the air band B together with the primary air band A across the height of the access opening 22 results in the cooling of the secondary air band B.

An ambient air hood 96 is attached to top wall 14 and front housing wall 84 in order to contain a motor-driven ambient air fan 98 which is powered by a unidirectional motor 100. Ambient air C is drawn into the ambient air hood 96 and forced downwardly through louvers 102 in order to establish the outer ambient air band C which, during the refrigeration cycle, sweeps away from the front of cabinet 10 across the front bumper skirt 104 which also provides structural support for the bumper 106. A front decoration panel 108 is located immediately below the bumper skirt 104 on the outside of the structural front wall 12.

As shown in FIGS. 1 and 2, a gate means 110 is located on the rear portion of top wall 14 and consists of a series of cover plates, illustrated by cover plate 112 which has a hinge 114 attached to top wall 14 and a multiple link mechanical linkage system 116 which is powered by electric motor and gear assemblies 118. Cover gate 112 remains in a closed position over air outlet port 120 during the refrigeration cycle of operation as shown in FIG. 1. Secondary air band B is propelled upwardly in the second air conduit 50 between rear wall 16 and rear divider panel 48 and is then circulated around the sides of outlet port walls 121, 122, 124, 126, 127 and 128 as shown in FIG. 3. This secondary air band B then continues in the second air conduit 50 into the secondary air housing which extends over the length of the cabinet 10.

The operation of cabinet 10 in the defrost cycle is shown in FIGS. 2 and 3. The following operational defrost sequence is initiated by the defrost control mechanism associated with the cabinet 10:

1. Refrigerant flow within the coils of boxes 70, 72 and 74 is terminated.

2. Motor-driven fan 90 which propels the secondary air band B is switched off.

3. Cover gate 112 is pivoted about hinge 114 by reason of operation of electric motor 118 through the linkage system 116 and the upper portion 132 of conduit 44 is blocked by baffle plate 134.

4. Motor-driven fan 64 and ambient air fan 98 are increased in speed to higher rpm operation in order to affect an increased air flow in both the primary air band A and the ambient band C by about 25 to 50% of the flow volume during the refrigeration cycle.

Operation step 3 permits the defrost ambient air D flowing upwardly in the first air conduit 44 to be expelled from cabinet 10 through air outlet port 120 and to then be dumped to the rear of cabinet 10 as shown by the dotted arrows at the upper right corner of FIG. 2. The air flow bands during the defrost cycles are shown by dashed arrows C for ambient and D for the defrost ambient air after contact with the refrigeration coils in boxes 70, 72 and 74. Moisture which is produced by the defrosting of the coils runs off via drain channel 130 located in bottom wall 18.

A baffle plate 134 is pivotally connected to the rear under edge of the top divider panel 46 to prevent the warm ambient defrost air D from reentering the top portion 132 of the first air conduit 44 and to thereafter flow downwardly through louvers 62 and be dumped into product display space 24 whereby thermal shock could occur to the stored products. An operator link 136 connects baffle plate 134 with the cover gate 112. During movement of cover gate 112 upwardly to the position shown in FIG. 2 via the motive force of electric motor 118 the mechanical motion transmitted through link 136 causes baffle plate 134 to close across the entire length of the upper portion 132 of the first air conduit 44. This closing of the baffle plate 134 effectively blocks air flow in the upper portion of the first air conduit whereby reciculation of the ambient air C which is provided for across the access opening 22 at the front of cabinet 10 during the refrigeration cycle is prevented from recirculation and dumping into product display space 24 during the defrost cycle.

Cover gate 112 is illustrated in FIG. 3 on the left hand side as the first cover gate of a series of two such cover gates. The other cover gate 138 is pivotally attached to top wall 14 by a hinge 140. These two gates cover air outlet ports 120 and 142, respectively, during the refrigeration cycle of operation. As illustrated in FIG. 3, both cover gates are opened for the expulsion of defrost ambient air D out of cabinet 10. Baffle plate 134 is shown attached to the lower side of top divider panel 46 by a hinge 144. The cover gates 112 and 138 are connected to baffle plate 134 by two operator links each. Gate 112 is connected to baffle plate 134 by strap links 136 and 146 and gate 138 is connected by strap links 148 and 150. Each of the unitary strap links are pivotally mounted at each end as illustrated by the pivot connections 152 and 153 for link 136, connections 154 and 155 for link 146, and pivot connections 156, 157, 158 and 159 for strap links 148 and 150. Each strap link has a bend 160 and 162 as shown for links 136 and 148, respectively. The angle of these bends can be seen in FIGS. 1 and 2.

Mechanical linkage system 116 on motor 118 is constructed of a swing arm 164 affixed to the gear output shaft and a pivotally attached pull arm 166. Arm 166 is provided with pivot attachments 168 and 170 at both ends, the latter of which is connected to operator bar 172 which extends over the tops of cover gates 112 and 138. Operator bar 172 is, in turn, pivotally connected by attachments 174 and 176, respectively, to the top surfaces of cover plates 112 and 138. When these two cover plates are in closed positions as shown in FIG. 1 and a defrost cycle is commenced, the operation of motor and gear assembly 118 according to defrost cycle step 3 above causes swing arm 164 to rise and to pull operator bar 172 upwardly through force transmitted by pull arm 166. This motive action lifts cover gates 112 and 138 away from the air outlet ports 120 and 142. Each of the cover plates 112 and 138 are constructed with plug portions 178 and 180, respectively, for interfitting with the air outlet ports. The cover gates are free from sticking due to frost formation since they open outwardly.

The spacing and arrangement of the two cover gates 112 and 138 shown in FIG. 3 can be used for a refrigerated display cabinet which is eight feet in length. The cover gates are each about three feet long and four inches wide. They are spaced six inches in from the end walls 20 and 182. When a display cabinet twelve feet in length is constructed, three such equally spaced cover gates are used and connected to baffle plate 134. It is also possible to operate each cover gate by an individually linked motor and gear assembly.

The refrigerated display cabinet 10 shown in FIGS. 1–3 is also equipped with a front lighting cowl 183 which contains a light fixture 184 for retaining two fluorescent light tubes 185 and 186. A light shield 188 is also provided to prevent light emitted from tubes 185 and 186 from shining directly into the customers eyes. Internal front panels 189 and 190 are provided for separating the ambient air hood 96 from the light cowl 183. An ambient air skirt 192 is arranged immediately under the light cowl 183 for directing the ambient air stream downwardly. A lower light fixture 194 is mounted on the top edge of front structural wall 12 and contains a series of fluorescent light tubes illustrated by tube 196. Support legs 197 and 198 are also provided for cabinet 10. Air grille 34 can be constructed with a plurality of hot gas lines 199 which are taken from the refrigeration compressor prior to cooling of the fluid in the condenser in order to prevent the formation of condensate or frost on the grille 34.

Figure 5:
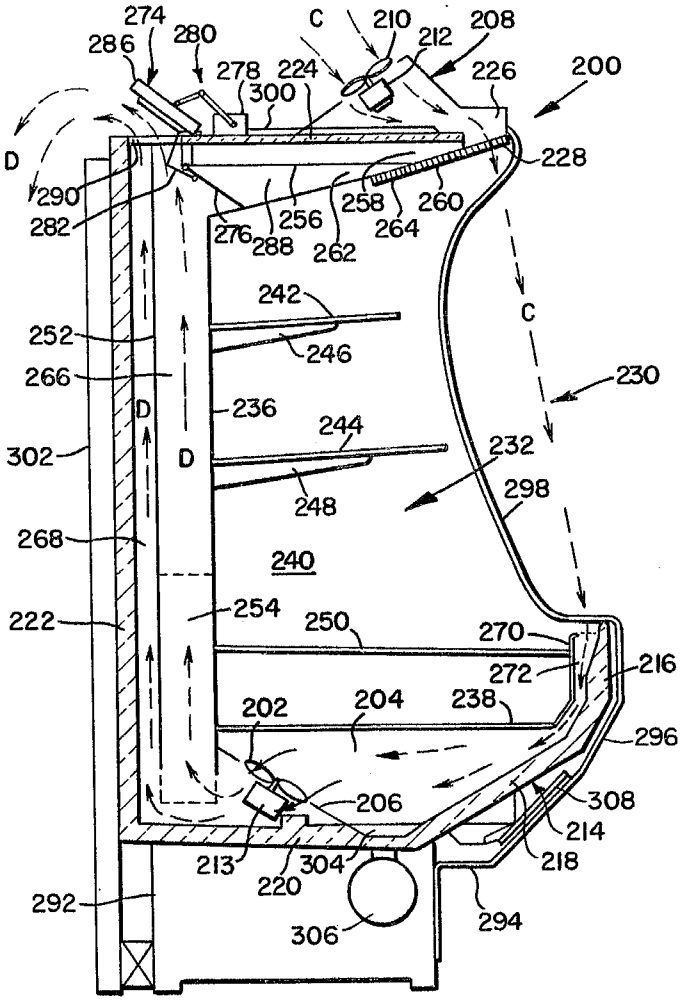
FIG. 5 shows a schematic cross-sectional view of the cabinet illustrated in FIG. 4 in a defrost cycle of operation.
Figure 4:
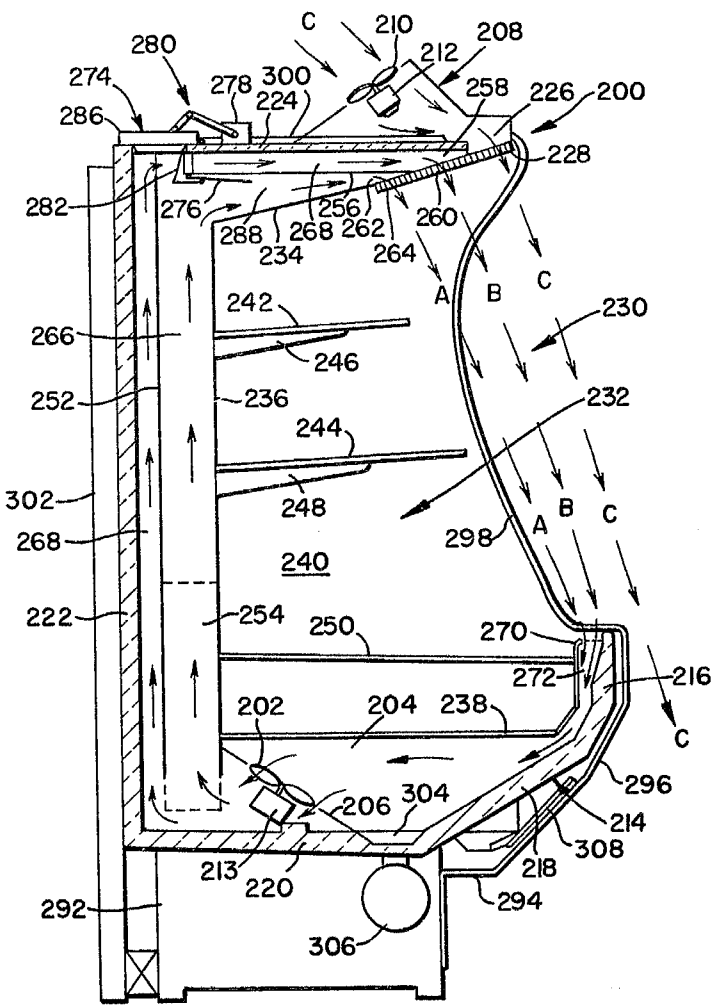
FIG. 4 is a cross-sectional schematic diagram of a modification of the cabinet illustrated in FIGS. 1–3 shown in a refrigeration cycle of operation wherein two inner air bands and an outer ambient air band are provided and a common inlet chamber for the two inner air conduits.

Referring now to FIGS. 4 and 5, a second modification of a refrigerated display cabinet of the present invention is shown as cabinet 200 which is designed to operate with a single unidirectional motor-driven fan 202 positioned in a common inlet chamber 204 by a fan bracket 206. An ambient fan hood 208 is also provided for supporting an ambient motor-driven fan 210 which is powered by a unidirectional, multispeed electric motor 212. The electric motor 213 for motor-driven fan 202 is of similar type. These two unidirectional fans 202 and 210 create three air bands: a primary refrigerated air band A, a secondary circulated air band B located to the exterior of the first band, and an outer ambient air band C.

Referring now to the structure of cabinet 200, a front wall 214 is formed from a generally vertical front portion 216 and an inclined portion 218 which connects by the lower edge thereof to a bottom wall 220, which is in turn connected by its rear most edge to an outer rear wall 222. The upper edge of rear wall 222 is connected to top wall 224 which also supports the ambient fan housing 208. An ambient air outlet 226 is formed between the front edge of top wall 224 and the front most portion of ambient air housing 208. Downwardly directed louvers 228 are provided to direct the ambient air band C downwardly across the access opening 230. A product display space 232 is formed by a top interior wall 234, a rear interior wall 236, a bottom wall 238 and the end wall 240. Two product shelves 242 and 244 are supported by brackets 246 and 248 mounted upon rear interior wall 236. A bottom shelf 250 is also provided. The space between bottom wall 238 and shelf 250 can also be used for refrigerated product storage.

The space between outer rear wall 222 and interior rear wall 236 is separated by a rear divider panel 252 which extends from a position along the side of refrigeration coil box 254 elevated from bottom wall 220 upwardly to approximately the height of the top wall 224. A top divider panel 256 is positioned between interior top wall 243 and exterior top wall 224 in order to form a second air conduit outlet 258 at the front portion thereof immediately above the downwardly directed louvers 260. A first air conduit outlet 262 is formed immediately below divider panel 256 and is provided with downwardly directed louvers 264 in a like manner. The rear divider panel forms a first air conduit 266 in cooperation with inner rear wall 236. A second air conduit 268 is then formed between rear divider panel 252 and the rear wall 222. This second air conduit 268 also continues on top of top divider panel 256. The divided primary air band A and secondary air band B are then circulated downwardly through the outlet openings 262 and 258 respectively and these two inner air bands are then drawn through air grille 270 located immediately to the rear of vertical front wall 216. The combined air streams are then circulated into the common inlet throat 272 and thence into the common inlet chamber 204 by the motor-driven fan 202. The two air streams are again divided by rear divider panel 252 and propelled upwardly in their respective air conduits 266 and 268. The lower portion of the refrigeration coil box 254 is connected primarily by the secondary air band whereas the upper portion of the coils are contacted primarily by the primary air band A.

Also shown in FIG. 4 is a gate means 274 which is similar in construction and operating details to gate means 110 described with respect to FIGS. 1–3. A baffle plate 276 is connected to the rear edge of upper divider panel 256 for operation by electric motor and gear assembly 278 through the linkage system 280 and the strap link 282 which is pivotally connected to the under surface of cover gate 286 and to baffle plate 276. The raising of cover gate 286 causes the pivoting of the baffle plate 276 in order to close the top portion 288 of the first air conduit 266 against flow of ambient defrost air in the refrigeration cycle as illustrated in FIG. 5. In the modification shown by cabinet 200, both the first air conduit 266 and the second air conduit 268 are opened at the top of the cabinet when the cover gate 286 is in a raised position as shown in FIG. 5. This allows the expelling of defrost ambient air through both of the air conduits in order to achieve a faster defrost action. While some flow of ambient defrost air from the vertical portion of the second air conduit 268 is possible into the top portion of the conduit around the air outlet port 290 the greater resistance to flow through the upper portion of the second air conduit 268 and the downwardly directed louvers 260 compared to air movement through port 290 prevents significant air movement. In this manner, the principal air flow during the defrost cycle of operation is upwardly and out of the air outlet port 290 whereby the ambient defrost air D is dumped behind the cabinet 200.

The following steps occur to carry out a defrost cycle:

1. The defrost control mechanism associated with display cabinet 200 senses via temperature sensing devices the need for defrosting of the refrigeration coil box 254 or, if desired, a periodic timer determines the initiation of a defrost cycle.

2. Refrigerant flow within the coils of box 254 is terminated.

3. The top cover gate motor 278 is activated to open the air outlet port 290 by raising cover gate 286.

4. The speed of both the ambient air fan 210 and the common air fan 202 are increased in order to move approximately 25 to 50% increased air flow through the cabinet during the defrost cycle.

The operation of the cabinet 200 during a defrost cycle of operation is illustrated in FIG. 5 wherein the ambient air fan 210 draws in ambient air which is then forced downwardly through downward directed louvers 228 in order to provide a protective air curtain across the access opening 230. The ambient air is then drawn into the inlet throat 272 and then into the common inlet chamber 204 via operation of the common fan 202. The defrost ambient air D is then expelled from the cabinet 200 through air outlet port 290 which provides for the exhausting of air from both the first air conduit 266 and the second air conduit 268.

Defrosting of the coil box is accomplished in approximately 15 to 20 minutes and the above steps are reversed in the control sequence in order to re-establish the refrigeration cycle.

A pedestal support 292 is provided for cabinet 200 and the end wall 240 has a bottom trim member 294, front trim member 296 with an extended vertical portion 298 and a continuing top trim member 300. A rear trim member 302 is seen extending to the rear of rear wall 222. A water drain 304 and a run-off conduit 306 are also provided.

The front wall 214 of display cabinet 200 can be provided with decorative panels 308 if desired.

A plurality of conduit fans illustrated by the common inlet fan 202 and the ambient air band fan 210 shown in FIGS. 4 and 5 are spaced along the length of cabinet 200 shown in FIG. 1. A similar longitudinal spacing of fans is also used for cabinet 10 in FIGS. 1–3. For example, two each of these fans are normally provided for an eight foot long case or three each of the primary and secondary fans are provided for a twelve foot case. By way of example, but not limitation, the overall height of cabinet 200 is approximately 82 inches and the width is approximately 45 inches. Such cabinets are manufactured in lengths up to 72 feet.

Figure 6:
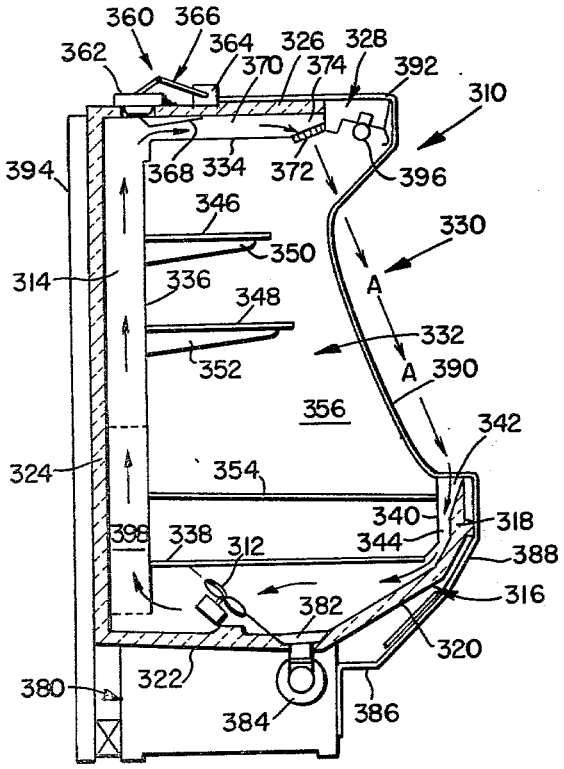
FIG. 6 illustrates a schematic cross-sectional view of a modification of the cabinet illustrated in FIGS. 1–3 shown in a refrigeration cycle of operation wherein a single refrigerated air band is provided.
Figure 7:
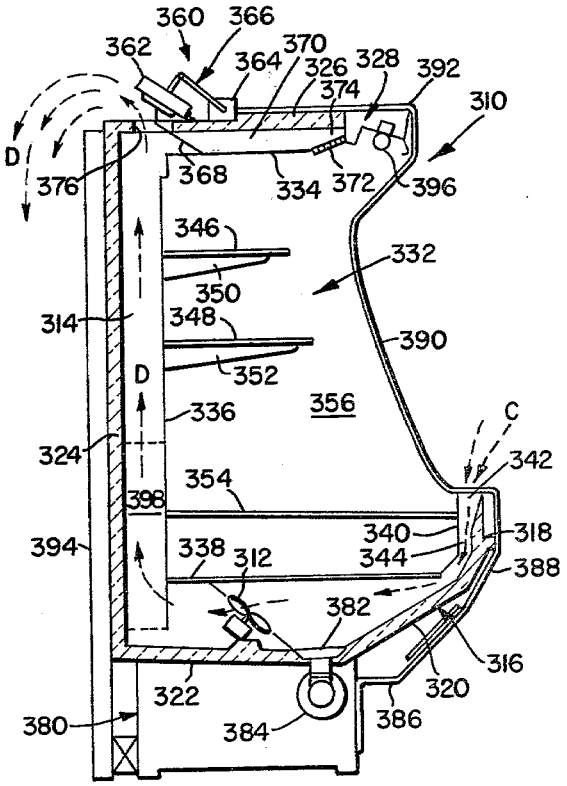
FIG. 7 illustrates the cabinet of FIG. 6 in a defrost cycle of operation.

Referring now to FIGS. 6 and 7, a second modification of the display cabinet 10 shown in FIGS. 1–3 is provided in which a single refrigerated air band A is circulated through a single air conduit in order to provide for refrigeration of cabinet 310. This cabinet while generally similar to cabinet 200 described with respect to FIGS. 5 and 6 does not have the internal dividing panels whereby a second air conduit is formed. A single motor-driven fan 312 propels the refrigerated air band A in a clockwise motion through the single air conduit 314 as shown in FIG. 6. The cabinet 310 is formed with a front wall 316 which consists of a vertical upper portion 318 and a lower inclined portion 320. Lower portion 320 is connected by its lower edge to a bottom wall 322 which is in turn connected by its rear edge to outer rear wall 324. A top wall 326 is connected to the top rear portioin of rear outer wall 324. A light cowl 328 is mounted on the front edge of top wall 326. An access opening 330 is formed between the light cowl and the top portion of upper front wall 318. A product display space 332 is defined by an interior top wall 334, an interior rear wall 336 and a bottom interior wall 338. A front interior wall 340 connects with an air grille 342 and forms an inlet air throat 344 by reason of being spaced from front upper wall portion 318. Product display shelves 346 and 348 are provided with support brackets 350 and 352 respectively and a bottom shelf 354 is also provided. Refrigerated product storage is provided below bottom shelf 354 in the space above bottom wall 338. The product display space 332 is also bound by end wall 356. A gate means 360 consisting of a cover gate 362 and an electric motor and gear assembly 364 operative through a linkage system 366 is similar to the gate means 110 described with respect to FIGS. 1–3. As in the description of the above figures, a baffle plate 368 is provided for blocking the flow of ambient air from flowing in the upper portion 370 of the air conduit 314. Baffle plate 368 is rigidly affixed to the under surface of gate 362 and functions to prevent the defrost ambient air from discharging through the downwardly directed louvers 372 into the product display space 332 during a defrost cycle. In this manner the defrost ambient air D is expelled out the rear portion at the top of display cabinet 310 and is not dumped back into the product display space 320 so that thermal shock to the stored products is prevented. An air outlet 374 is formed by the top wall 326 and the interior top wall 334 immediately above downwardly directed louvers 372. The inlet throad 334 constitutes the inlet for both the refrigerated air stream A and the ambient air C during a defrost cycle of operation. The air flow during the defrost cycle of operation is illustrated in FIG. 7 by dashed arrows as in the above figures. In the modification shown by display case 310, the air outlet port 376 is simply an opening in top wall 326 and structural walls for the outlet openings such as shown in FIG. 3 are not required. Thus, the cover gate 326 can extend longitudinally along the entire length of cabinet 310 and only a single centrally positioned motor 364 or several such electrical motors need be employed in order to open the entire top of the case for expelling the ambient defrost air D. The other structural elements of display cabinet 310 are similar to those described with respect to cabinet 200 in FIGS. 5 and 6. Thus, a pedestal support 380, a drain channel 382 and a drain conduit 384 are provided as well as end panel trim members 386, 388, 390 and top trim member 392. Also, a rear trim member 394 is provided. Light cowl 328 contains a fluorescent light tube 396.

During the defrost cycle of operation the following steps occur:

1. Refrigerant flow within the coils in refrigeration coil box 398 is terminated.

2. Electric motor 364 is activated to raise cover gate 362 from air outlet port 376.

3. The speed of motor-driven fan 312 is increased but operated in the same direction as in the refrigeration cycle and the upper portion 370 of the air conduit 314 is blocked against air flow by baffle plate 368.

After the ice and frost accumulated on the refrigeration coils in box 398 has been melted and drained off through the conduit 384, the above steps are reversed in order to reinstitute the refrigeration cycle of operation.

In each of the refrigerated display cabinets, 10, 200, and 310 illustrated in FIGS. 1–7, the circulation of at least one refrigerated air band is provided for during a refrigeration cycle of operation. During the defrost cycle of operation, ambient air is drawn through the air conduit which provides for circulation of the refrigerated air band in the same direction as during the refrigeration cycle with the exception that the flow of ambient air is blocked against flow in the upper portion of the refrigerated air band conduit by a baffle plate. At the same time, the cover gate which closes an air outlet port located near the rear of the top wall is opened to divert the defrost ambient air flow toward the rear of the cabinet whereby it is not dumped into the product storage and display space. If desired, a partial secondary air conduit can be incorporated as illustrated by cabinet 200. Ambient air band generating fan systems are preferrably employed as illustrated by cabinets 10 and 200. Also for additional circulation motive force, a series of motor-driven fans can be installed in the second air conduit as illustrated by fan 90 in cabinet 10 of FIGS. 1–3. In these display cabinets the primary air band A and the secondary band B are aerodynamically balanced between the outlets and inlets of the respective conduits so that air leaving the outlet openings is directed across the access opening of the cabinet and received in the inlet opening.

The baffle plates blocking flow in the upper portion of the first air conduit can also be independently powered by an electric motor and gear assembly. In this modification, the electric motor powering the baffle plate is synchronized with respect to activation of the motor or motors which raises the cover gates. The mechanical linkage systems which are illustrated in FIGS. 1–7 and permit a single electric motor to operate ganged cover gates and to also close the baffle plate is preferred. Another modification is that separate motor and gear assemblies can be utilized for raising each of the cover gates.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and described to be secured by Letters Patent is:

1. In an open front display cabinet having top, bottom, side, and end walls defining a display space and having aperture means in at least two walls thereof for communicating ambient outside air into said cabinet, said aperture means comprising an access opening for permitting products to be moved into and out of said display space and at least one air outlet port; at least one air conduit positioned about said display space for enabling circulation of a primary air band and said air conduit having an outlet opening and an inlet opening at opposite ends thereof so that air leaving said outlet opening is directed across said access opening and received into said inlet opening; an air moving means for propelling said primary air band through said air conduit during a refrigeration cycle and for propelling ambient air through said air conduit during a defrost cycle; and refrigeration means arranged within said air conduit for selective operation in a refrigeration and in a defrost cycle; the improvement comprising:

a gate means selectively operative to close said air outlet port during the refrigeration cycle of operation and for opening said port during a defrost cycle, a baffle plate for blocking the passage of air in said air conduit during a defrost cycle of operation, and said air moving means enabling the circulation of air in a refrigeration cycle within said air conduit and across said access opening from said outlet opening into said inlet opening and for enabling the circulation of ambient air through said access opening during a defrost cycle of operation, across said refrigeration means, and for expelling the defrost ambient air through said air outlet port.

2. The improvement according to claim 1, wherein said baffle plate is connected to the undersurface of said gate means by operator links.

3. The improvement according to claim 1, wherein said baffle plate is simultaneously operative with said gate means during the initiation and termination of the defrost cycle of operation.

4. The improvement according to claim 1, wherein said baffle plate is connected to said gate means by linkage means for enabling the motion of said gate means to control the position of said baffle plate.

5. The improvement according to claim 1, wherein said air moving means comprises at least one unidirectional motor-driven fan set for propelling air in said air conduit in the same direction in both the refrigeration and the defrost cycle of operation.

6. The improvement according to claim 5, wherein the motors of said fan set are variable speed.

7. The improvement according to claim 1, wherein a second air conduit is provided within said cabinet for enabling the flow of a secondary air band about a substantial portion of said display space during a refrigeration cycle of operation.

8. The improvement according to claim 7, wherein said second air conduit is arranged for expelling ambient defrost air outside of said cabinet through said air outlet port.

9. The improvement according to claim 1, wherein an ambient air moving means is provided for said cabinet for enabling the flow of an ambient air band during the refrigeration and the defrost cycles of operation.

10. The improvement according to claim 1, wherein two air conduits are provided and wherein said second air conduit is disposed about the first air conduit and has an outlet opening and an inlet opening arranged adjacent to said outlet opening and said inlet opening of said first air conduit, and wherein said air outlet port communicates with the first air conduit to enable expelling of defrost ambient air during a defrost cycle of operation.

11. The improvement according to claim 10, wherein said second air conduit has an air moving means located therein.

12. The improvement according to claim 10, wherein an ambient air moving means is arranged adjacent to said top wall of said cabinet for enabling the flow of an ambient air band across said access opening during the refrigeration and the defrost cycle of operations.

13. The improvement according to claim 1, wherein said air moving means enables an increased air flow volume during the defrost cycle of operation.

14. The improvement according to claim 1, wherein said air outlet port is positioned in the rear top portion of said display cabinet to prevent the ambient defrost air expelled therethrough during the defrost cycle from being drawn back into said display space.

15. The improvement according to claim 1, wherein said gate means is arranged for opening said outlet port by movement away from the outer wall of said cabinet.

16. The improvement according to claim 1, wherein said gate means comprises at least one cover gate for blocking air flow through said air outlet port during a refrigeration cycle of operation and a motive means for moving said cover gate at the initiation and termination of a defrost cycle of operation.

17. The improvement according to claim 1, wherein said baffle plate extends a substantial length along the longitudinal dimension of said cabinet and is connected to said gate means by mechanical linkages for enabling motion of said gate means to control the movement of said baffle plate.

18. The improvement according to claim 17, wherein said gate means comprises a cover gate for blocking air flow through said outlet port during a refrigeration cycle of operation and an electric motor and gear assembly linked to said cover gate for opening and closing said air outlet port.

19. The improvement according to claim 17, wherein said aperture means comprises a plurality of air outlet ports and wherein said gate means comprises a plurality of cover gates for blocking airflow through said outlet ports during a refrigeration cycle of operation and an electric motor and gear assembly linked to said cover gates for opening and closing said air outlet ports and for moving said baffle plate.

20. A display cabinet having top, bottom, side and end walls and an access opening in one of said side walls for enabling access to products displayed within said cabinet, said walls defining a display space, said cabinet including a refrigeration means capable of being selectively operated in a refrigeration cycle and a defrost cycle; said cabinet comprising:

at least one air conduit arranged about said display space and having an air outlet opening and an air inlet opening at opposite edges of said access opening and aerodynamically aligned so that air leaving said outlet opening is directed across said access opening and received into said inlet opening;

air circulating means positioned in said air conduit for propelling air therethrough in the same direction during both the refrigeration and the defrost cycle of operation;

defrost means for enabling venting of ambient defrost air propelled in said air conduit outside of said cabinet during a defrost cycle of operation;

said defrost means comprising a baffle plate for blocking air flow in said air conduit during a defrost cycle of operation; and, control means for controlling the operation of said cabinet and causing the circulation of refrigerated air through said air conduit during the refrigeration cycle of operation and during a defrost cycle of operation temporarily terminating operation of said refrigeration means and causing said defrost means to expell the ambient defrost air outside of said cabinet.

21. The display cabinet according to claim 20, wherein said defrost means comprises at least one air outlet port arranged for enabling the expelling of air propelled within said air conduit and comprising gate means for blocking air flow through said outlet port during a refrigeration cycle of operation and a motive means for moving said gate means at the initiation and termination of a defrost cycle of operation.

22. The display cabinet according to claim 21, wherein said gate means comprises at least one cover gate pivotally connected to said top wall of said display cabinet.

23. A display cabinet according to claim 21, wherein a plurality of air outlet ports and a plurality of gate means for blocking air flow therethrough during a refrigeration cycle of operation are provided and wherein motive means for said cover means is provided for moving said cover means at the initiation and termination of a defrost cycle of operation.

24. The display cabinet according to claim 20, wherein said baffle plate is simultaneously operative with said gate means during the initiation and termination of the defrost cycle of operation.

25. The display cabinet according to claim 20, wherein said baffle plate is connected to said gate means by linkage means for enabling the motion of said gate means to control the position of said baffle plate.

26. The display cabinet according to claim 20, wherein said air circulating means comprises at least one set of unidirectional, variable speed motor-driven fans for propelling air in said air conduit in the same direction in both the refrigeration and the defrost cycles of operation.

27. The display cabinet according to claim 20, wherein a second air conduit is provided within said cabinet for enabling the flow of a secondary air band about a substantial portion of said display space during a refrigeration cycle of operation.

28. The display cabinet according to claim 27, wherein said second air conduit is arranged for expelling ambient defrost air outside of said cabinet.

29. The display cabinet according to claim 20, wherein an ambient air moving means is provided for said cabinet for enabling the flow of an ambient air band across said access opening during the refrigeration and defrost cycles of operation.

30. The display cabinet according to claim 20, wherein two air conduits are provided and wherein said second air conduit is disposed about the first air conduit and has an outlet opening and an inlet opening arranged adjacent to the air outlet opening and the air inlet opening of the first air conduit, and wherein an air outlet port communicates with the first air conduit to enable expelling of defrost ambient air during a defrost cycle of operation.

31. The display cabinet according to claim 20, wherein said second air conduit has an air moving means located therein.

32. The display cabinet according to claim 20, wherein an ambient air moving means is arranged adjacent to said top wall for enabling the flow of an ambient air band across said access opening during the refrigeration and defrost cycles of operation.

33. The display cabinet according to claim 20, wherein said air circulating means enables an increase air flow volume during the defrost cycle of operation.

34. The display cabinet according to claim 20, wherein an air outlet port is positioned in the rear top portion of said display cabinet to prevent the ambient defrost air expelled therethrough during the defrost cycle from being drawn back into said display space.

35. The display cabinet according to claim 34, wherein said defrost means comprises at least one cover gate for blocking air flow through said air outlet port during a refrigeration cycle of operation and wherein said baffle plate extends a substantial length along the longitudinal dimension of said cabinet and is connected said cover gate by mechanical linkages for enabling motion of said cover gate to control the movement of said baffle plate.

36. The display cabinet according to claim 35, wherein an electric motor and gear assembly is linked to said cover gate for opening and closing said air outlet port at the initiation and termination of a defrost cycle of operation.

37. The display cabinet according to claim 20, wherein said defrost means comprises a plurality of air outlet ports connected to said air conduit and wherein said defrost means also comprises a plurality of cover gates for blocking air flow through said outlet ports during a refrigeration cycle of operation and a plurality of electric motor and gear assemblies linked to said cover plates for opening and closing said air outlet ports and for moving said baffle plate.

38. A method of operating an open front display cabinet having top, bottom, side and end walls defining a display space and having apertures in at least two walls thereof for communicating ambient outside air into said cabinet, the aperture means comprising an access opening for permitting products to be moved into and out of said display space and at least one air outlet port, at least one air conduit positioned about the display space for enabling circulation of a primary air band and the air conduit having an outlet opening and an inlet opening at opposite ends thereof so that air leaving the outlet opening is directed across the access opening and received into the inlet opening, an air moving means for propelling said primary air band through the air conduit during a refrigeration cycle and for propelling ambient air through the air conduit during a defrost cycle, and refrigeration means arranged within the air conduit for selective operation in a refrigeration and in a defrost cycle, gate means selectively operative to close the air outlet port during the refrigeration cycle of operation and for opening the outlet port during a defrost cycle, and a baffle plate for blocking the passage of air in the air conduit during a defrost cycle of operation; said method comprising the steps of:

circulating a refrigerated primary air band in the air conduit during a refrigeration cycle of operation in which the gate means is closed over the air outlet port, terminating operation of the refrigeration means to initiate the defrost cycle of operation, thereafter opening the gate means and causing the baffle plate to move into blocking position within the air conduit, and propelling air within the air conduit across the refrigeration means, expelling the air through the air outlet port in order to defrost the refrigeration means, at the termination of the defrost cycle of operation, closing the gate means over the air outlet port and commencing operation of the refrigeration means, and circulating the air band in the same direction in both the refrigeration and the defrost cycles of operation.

39. The method according to claim 38, wherein a secondary air band is circulated about the air conduit in a second air conduit during the refrigeration cycle of operation, and deactivating the secondary air band during the defrost cycle of operation.

40. The method according to claim 39, wherein the secondary air band is circulated about a substantial portion of the primary air band in a partial second conduit positioned within the display cabinet during both the refrigeration and the defrost cycles of operation.

41. The method according to claim 38, wherein an ambient air band is moved across the outside of the access opening during both the refrigeration and the defrost cycles of operations.

* * * * *

UNITED STATES PATENT AND TRADEMARK OFFICE

CERTIFICATE OF CORRECTION

PATENT NO. : 4,326,385

DATED : April 27, 1982

INVENTOR(S) : Fayez F. Ibrahim

It is certified that error appears in the above—identified patent and that said Letters Patent is hereby corrected as shown below:

Column 4, line 40, change "undersirable" to --undesirable--.

Column 5, line 19, change "emboidment" to --embodiment--.

Column 7, line 15, after "motor-driven" insert --fan--;

line 68, change "affect" to -effect".

Column 8, line 29, change "reciculation" to --recirculation--

Column 12, line 28, change "throad 334" to --throat 344--.

Column 15, line 57, change "expell" to --expel--.

Column 16, line 67, change "connected said" to --connected to said--.

Signed and Sealed this

Eighth Day of February 1983

[SEAL]

*Attest:*

GERALD J. MOSSINGHOFF

*Attesting Officer*

*Commissioner of Patents and Trademarks*